US010550834B2

(12) United States Patent
Arashi et al.

(10) Patent No.: US 10,550,834 B2
(45) Date of Patent: Feb. 4, 2020

(54) TUBE PUMP AND FLUID DELIVERY METHOD

(71) Applicant: PANASONIC INTELLECTUAL PROPERTY MANAGEMENT CO., LTD., Osaka (JP)

(72) Inventors: Kenjiro Arashi, Kyoto (JP); Masayuki Hirata, Osaka (JP); Takahiro Nakamura, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 189 days.

(21) Appl. No.: 15/126,091

(22) PCT Filed: Apr. 9, 2015

(86) PCT No.: PCT/JP2015/001999

§ 371 (c)(1),
(2) Date: Sep. 14, 2016

(87) PCT Pub. No.: WO2015/159519

PCT Pub. Date: Oct. 22, 2015

(65) Prior Publication Data

US 2017/0096993 A1 Apr. 6, 2017

(30) Foreign Application Priority Data

Apr. 18, 2014 (JP) ..... 2014-086146

(51) Int. Cl.
*F04B 43/08* (2006.01)
*F04B 43/00* (2006.01)
*F04B 45/06* (2006.01)

(52) U.S. Cl.
CPC ..... *F04B 43/08* (2013.01); *F04B 43/0072* (2013.01); *F04B 45/06* (2013.01)

(58) Field of Classification Search
CPC ..... F04B 43/08; F04B 43/0072; F04B 45/06
See application file for complete search history.

(56) References Cited

U.S. PATENT DOCUMENTS 4,906,168 A 3/1990 Thompson
5,846,061 A * 12/1998 Ledebuhr ..... F04B 43/1292 417/477.9

(Continued)

FOREIGN PATENT DOCUMENTS

CN 103423134 12/2013
JP 44-013026 5/1969

(Continued)

OTHER PUBLICATIONS

Chinese Office Action for CN App. No. 201580012170.4 dated Apr. 6, 2017.

(Continued)

*Primary Examiner* — Devon C Kramer
*Assistant Examiner* — David N Brandt
(74) *Attorney, Agent, or Firm* — Greenblum & Bernstein, P.L.C.

(57) ABSTRACT

A tube pump and a fluid delivery method, the tube pump including a plurality of pressing portions and a tube that delivers fluid. The pressing portions is spaced apart from each other in a rotational direction and provided for a rotation body turned by a drive unit and the tube is provided on an outer circumferential side of the rotation body. The tube pump includes a control unit that turns the rotation body opposite to a delivery direction until the rotation body reaches a predetermined angle so as to restore an area of the tube, pressed by the pressing portion on a most upstream side in the delivery direction, by an increase in pressure within the tube accompanied with a movement opposite to (Continued)

the delivery direction of the pressing portion adjacent to a downstream side in the delivery direction.

8 Claims, 4 Drawing Sheets

(56) References Cited

U.S. PATENT DOCUMENTS

| | | | | |
|---|---|---|---|---|
| 7,241,119 | B2 * | 7/2007 | Harada | B41J 2/17596 417/476 |
| 8,043,077 | B2 | 10/2011 | Miyazaki | |
| 8,491,285 | B2 * | 7/2013 | Haser | F04B 43/1238 417/477.2 |
| 2004/0141863 | A1 * | 7/2004 | Harada | F04B 43/0072 417/476 |
| 2015/0159642 | A1 * | 6/2015 | Sasa | F04B 43/1238 137/544 |

FOREIGN PATENT DOCUMENTS

| | | |
|---|---|---|
| JP | 54-085403 | 7/1979 |
| JP | 6-159261 | 6/1994 |
| JP | 06-198902 | 7/1994 |
| JP | 11-082324 | 3/1999 |
| JP | 3217518 | 10/2001 |
| JP | 2003-322090 | 11/2003 |
| JP | 2014-066254 | 4/2014 |
| WO | 92-00768 | 1/1992 |
| WO | 2007/036931 | 4/2007 |

OTHER PUBLICATIONS

International Search Report issued in International Application No. PCT/JP2015/001999, dated Jun. 30, 2015, along with English-language translation.

* cited by examiner

TUBE PUMP AND FLUID DELIVERY METHOD

BACKGROUND OF THE INVENTION

Field of the Invention

The disclosure relates to a tube pump that delivers fluid and a fluid delivery method.

Description of the Related Art

In a conventionally known tube pump, a pressing portion such as a pressure roller that presses a tube is provided for a rotation body, i.e. a rotor, rotated by a drive unit such as a motor, and the pressing portion is moved by rotating the rotation body, thereby delivering or conveying fluid. In the tube pump constituted as above, there has been a problem that, if the pump is stopped for a long time, an area of the tube pressed by the pressing portion becomes difficult to be restored and to perform a function of sucking fluid from a delivery source side, i.e. a self-suction function.

Patent Literature 1 below, for instance, discloses a tube pump constituted in such a manner that an adhesion-state prevention member such as a linear member or a belt-like member is inserted into a tube for estranging inner surfaces of an occluded portion of the tube caused by pressure of a pressure member after removing pressure force.

Patent Literature 2 below discloses a tube pump in which a guide plate rotating integrally with a pump drive shaft has a function to release a pressure state of a tube by a pressure roller when it is not in use. The tube pump is constituted in such a manner that the guide plate is provided with a guide hole in a long hole shape which movably retains the pressure roller in a tube pressure state or in a released state and, when it is not in use, the pressure roller is moved along the guide hole by reversely rotating the pump drive shaft, thereby becoming the pressure released state.

CITATION LIST

Patent Literature

PTL 1: Japanese Unexamined Patent Application Publication No. 1999-82324

PTL 2: Japanese Patent No. 3217518

SUMMARY OF THE INVENTION

Problems to be Solved by the Invention

The tube pumps described in Patent Literature 1 and Patent Literature 2 have such a problem that the structure of the tube itself and the structure of the guide plate that moves the pressure roller are complicated. Further improvement is desirable in view of seal performance (occlusive performance) of the tube by the pressure member or the pressure roller.

The present invention is proposed in view of the above-mentioned problems. An object of the present invention is to provide a tube pump stably performing fluid delivery control and a fluid delivery method using such a tube pump with a simplified constitution of the tube pump.

Means of Solving the Problems

In order to achieve the above-mentioned object, in a tube pump of one aspect of the present invention including a plurality of pressing portions, the pressing portions spaced apart from each other in a rotational direction and provided for a rotation body turned by a drive unit; and a tube that delivers fluid, the tube provided on an outer circumferential side of the rotation body, the tube pump includes a control unit that turns the rotation body opposite to a delivery direction until the rotation body reaches a predetermined angle so as to restore an area of the tube by an increase in pressure within the tube accompanied with a movement opposite to the delivery direction of the pressing portion adjacent to a downstream side in the delivery direction, the area of the tube pressed flat by the pressing portion on a most upstream side in the delivery direction.

In order to achieve the above-mentioned object, in a fluid delivery method using a tube pump of one aspect of the present invention including a plurality of pressing portions, the pressing portions spaced apart from each other in a rotational direction and provided for a rotation body turned by a drive unit; and a tube that delivers fluid, the tube provided on an outer circumferential side of the rotation body, the rotation body is turned in a delivery direction after being turned opposite to the delivery direction until the rotation body reaches a predetermined angle so as to restore an area of the tube by an increase in pressure within the tube accompanied with a movement opposite to the delivery direction of the pressing portion adjacent to a downstream side in the delivery direction, the area of the tube pressed by the pressing portion on a most upstream side in the delivery direction.

Effects of the Invention

Constituted as above, the tube pump and the fluid delivery method using such a tube pump of one aspect of the present invention, simplify the constitution of the tube pump and stably perform fluid delivery control.

DESCRIPTION OF THE EMBODIMENTS

An embodiment of the present invention is explained below based on the drawings.

FIGS. 1 to 4 schematically show an example of the tube pump in the embodiment and an example of a fluid delivery method in the embodiment executed with the above-mentioned example of the tube pump.

Figure 1B:
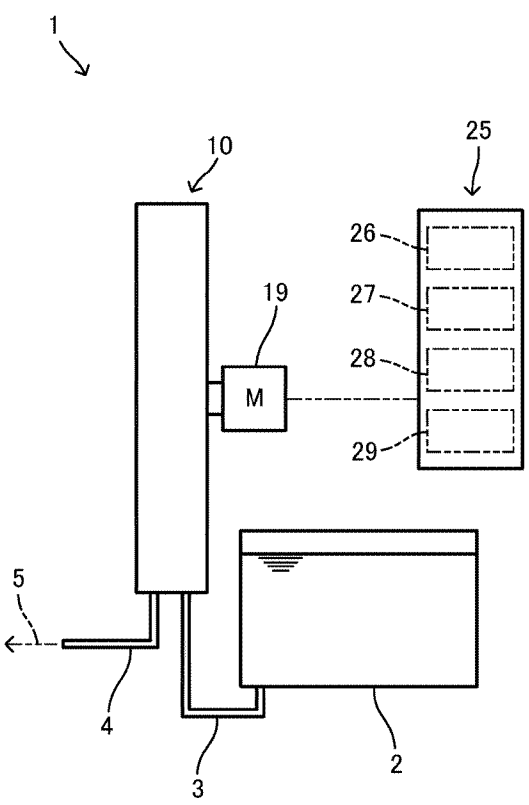
FIG. 1B is a system configuration diagram schematically showing an example of a fluid delivery system in which the tube pump is incorporated.
Figure 1A:
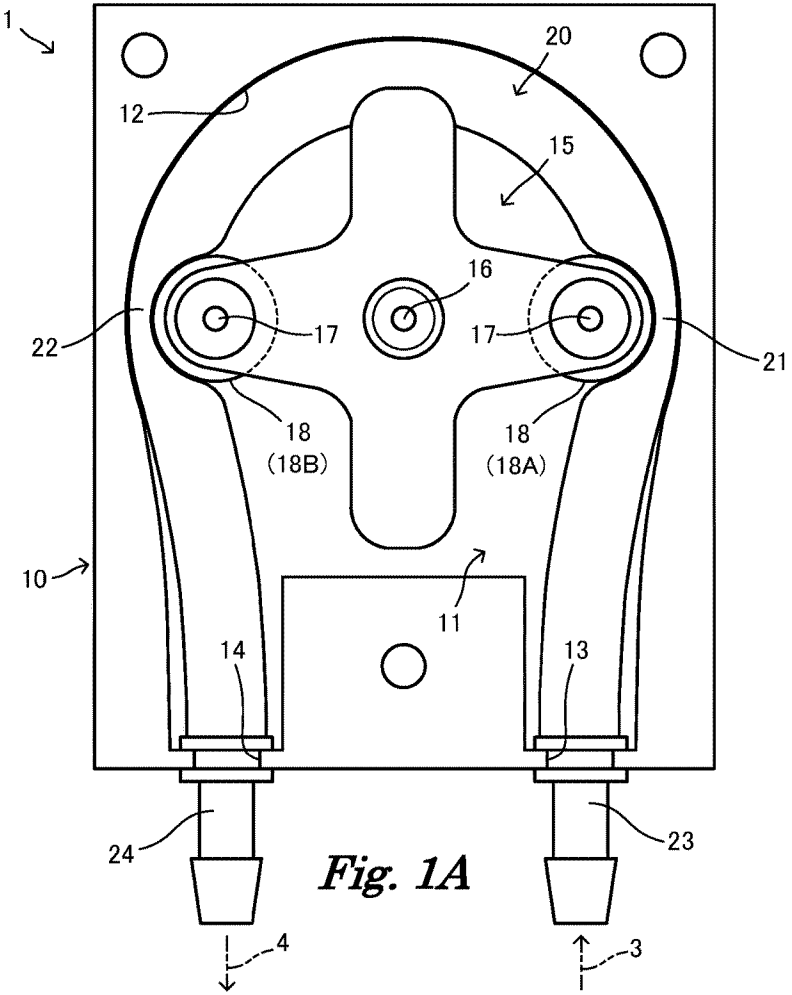
FIG. 1A is a partially omitted plane view schematically showing an example of the tube pump of an embodiment of the present invention.

As shown in FIGS. 1 to 3, a tube pump 1 in the embodiment is constituted in such a manner that a plurality of pressing portions 18, 18 are spaced apart from each other in a rotational direction and provided for a rotation body 15 turned by a drive unit 19 and a tube 20 that delivers fluid is provided on an outer circumferential side of the rotation body 15. The tube pump 1 has a control unit 26 that turns the rotation body 15 opposite to a delivery direction, i.e. reverse rotation, until the rotation body 15 reaches a predetermined angle so as to restore an area 21 of the tube 20 by an increase in pressure within the tube 20 accompanied with a movement opposite to the delivery direction of a pressing portion 18 (18B) adjacent to a downstream side in the delivery direction, in which the area 21 of the tube 20 is pressed by a pressing portion 18 (18A) on the most upstream side in the delivery direction. The tube pump 1 is constituted to deliver or convey fluid in the tube 20 by rotating the rotation body 15 in the delivery direction, i.e. normal rotation, and moving the pressing portions 18, 18. In FIGS. 1A, 2, and 3, clockwise rotation is set as reverse rotation of the rotation body 15, and counterclockwise rotation is set as normal rotation of the rotation body 15.

The tube pump 1 has a casing-shaped pump body 10 which houses the rotation body 15 and the tube 20. In the embodiment, the pump body 10 is constituted to house a single rotation body 15 and a single tube 20.

The pump body 10 has a housing recess 11 which opens toward one direction, i.e. in an axial direction of the rotation body 15 or in a direction of the rotating shaft 16. A lid body, not shown in figures, is provided for the pump body 10 to cover the housing recess 11.

The housing recess 11 has a recess-curved face portion 12 along which the tube 20 is arranged in a curved state. The recess-curved face portion 12 is formed in a circular arc shape coaxially, i.e. concentrically, with the rotating shaft 16 seen from the axial direction. The figures show an example in which the recess-curved face portion 12 is formed substantially in a semi-circular arc shape seen from the axial direction.

The pump body 10 has insertion portions 13, 14 into which an upstream side area 23 on a delivery source side of the tube 20 and a downstream side area 24 on a delivery destination side are respectively inserted. The insertion portions 13, 14 are arranged so as to go through a side portion on a side opposite to a center area of the recess-curved face portion 12 in such a manner that, seen from the axial direction, the tube 20 becomes a substantial U shape in the housing recess 11. Both inner side faces of the housing recess 11 which continue into both end sides of the recess-curved face portion 12 are formed to be connected to the insertion portions 13, 14.

The figures show an example in which the insertion portions 13, 14 are set as retaining portions which retain base end portions of connection portions (connectors, coupling joints) 23, 24 as an upstream side area and a downstream side area of the tube 20.

The rotation body 15 is constituted in such a manner that a plurality of pressing portions 18, 18 are provided on an outer circumferential side of the rotating shaft 16 so as to be located at an equal distance from the rotating shaft 16. In other words, seen from the axial direction, the pressing portions 18, 18 are provided for the rotation body 15 so as to be located at a same circumference of which a center is identical with the rotating shaft 16. The pressing portions 18, 18 are provided so as to be spaced at equal intervals in a rotational direction of the rotation body 15 around the rotating shaft 16.

In the embodiment, the two pressing portions 18, 18 are provided around the rotating shaft 16 of the rotation body 15. In other words, the two pressing portions 18, 18 are provided for the rotation body 15 in such a manner that respective intervals in the rotational direction become angles of 180 degrees. In the figures, the pressing portions 18, 18 are arranged at distal end portions of areas arranged in arm shapes (spoke shapes) so as to project from the rotating shaft 16 in a radial direction.

In the embodiment, the pressing portions 18, 18 are press rollers which are rotatable around roller shafts 17, 17 parallel to the rotating shaft 16 of the rotation body 15.

As shown in FIG. 1A, when the rotation body 15 is at a stop position, i.e. an initial position, the pressing portions 18, 18 are disposed opposite to an upstream side end and an downstream side end which are both ends of the recess-curved face portion 12 of the pump body 10, thereby pressing the tube 20 along with the recess-curved face portion 12. Namely, in the embodiment, the rotation body 15 is at the initial position and presses two placed pressed areas 21, 22 of the tube 20 by the pressing portions 18, 18. At the initial position as shown in FIG. 1A, the example shows that a first pressing portion 18A which is located at the most upstream side among a plurality of pressing portions 18, 18 in the delivery direction and the upstream side end of the recess-curved face portion 12 press the pressed area 21 on the upstream side of the tube 20. At the initial position as shown in FIG. 1A, the example shows that a second pressing portion 18B which is adjacent to the downstream side of the first pressing portion 18A in the delivery direction and the downstream side end of the recess-curved face portion 12 press the pressed area 22 on the downstream side of the tube 20. In such a state that the rotation body 15 is stopped at the initial position, the respective pressed areas 21, 22 of the tube 20, which are pressed, are occluded and fluid delivery becomes impossible, i.e. delivery stop occurs.

The above-mentioned initial position of the rotation body 15 is an example and the rotation body 15 can be at other positions.

As shown in FIG. 1B, the upstream side connection portion 23 of the tube 20 can be connected with a delivery source side pipe line 3 connected to a storage portion 2 which is a fluid delivery source. The downstream side connection portion 24 of the tube 20 can be connected with a delivery destination side pipe line 4 which delivers fluid to a fluid delivery destination 5. The upstream side further than the pressed area 21 on the upstream side of the tube 20 can be appropriately provided as needed with a backflow prevention valve which prevents backflow of fluid toward a delivery source side 2, an opening and closing valve, or the like.

The tube 20 can be made of an elastomer based material which is elastic enough to restore the area pressed by the pressing portions 18, 18, for instance, natural rubber or synthetic resin based elastomer such as EPDM, silicone, or neoprene. An appropriate material can be adopted for the tube 20 according to the types or the like of delivering fluid. An inner diameter of the tube 20, a length along the recess-curved face portion 12, or the like can be appropriately set according to a flow rate or the like which delivering fluid requires. Fluid delivered by the tube pump 1 can be liquid of various types, emulsion-like liquid, i.e. latex like liquid, slurry-like liquid, or gas.

The drive unit 19 which rotates the rotation body 15 is constituted to be able to rotate the rotation body 15 normally and reversely around the rotating shaft 16. As for the drive unit 19, a so-called gear motor or the like which has a gear mechanism such as various speed reduction gears connected to the rotating shaft 16 can be adopted. Since the above-mentioned drive unit 19 is required to stop the rotation body 15 at an appropriate rotation position, i.e. a rotation angle, a motor with a brake which is able to control the rotation position, a servo motor or the like can be adopted as the drive unit 19. A detector such as a rotation angle sensor which detects the rotation position of the rotation body 15 can be appropriately provided.

As shown in FIG. 1B, the drive unit 19 is connected to a control panel 25 which has the control unit 26. The rotation body 15 is rotated in such a manner that the operation of the drive unit 19 is controlled by the control unit 26, thereby fluid delivery (discharge) is performed as mentioned below.

The control unit 26 is constituted by, for instance, a control circuit such as CPU. In the embodiment, the control unit 26 executes control which maintains the rotation position of the rotation body 15 rotated opposite to the delivery direction during a predetermined time as mentioned below.

In addition to the control unit 26, the control panel 25 is appropriately provided with a memory unit 27, a power supply unit 28, a display operation unit 29, and the like; the memory unit 27 is constituted by a memory or the like and stores various operation programs; the power supply unit 28 supplies drive power to the drive unit 19; and the display operation unit 29 receives and displays operation input. The control panel 25 can be provided for the tube pump 1 itself or for various devices and systems, i.e. fluid delivery systems, into which the tube pump 1 is incorporated.

In the tube pump 1 constituted as above, as shown in FIG. 3, when the rotation body 15 is rotated normally from the initial position, a self-suction and delivery of fluid are performed accompanied with the movement of the pressing portions 18, 18. In other words, as shown in FIGS. 3A and 3B, when the first pressing portion 18A which is located at the most upstream side moves toward the delivery direction, the pressed area 21 on the upstream side of the tube 20 which is pressed by the pressing portion 18 restores. By a negative pressure function accompanied with restoration of the pressed area 21 on the upstream side, fluid from the delivery source side 2, i.e. the delivery source side pipe line 3, flows into the upstream side area of the tube 20. When the second pressing portion 18B which is located at the most downstream side moves in the delivery direction so as to estrange from the tube 20, the pressed area 22 on the downstream side of the tube 20 which is pressed by the pressing portion 18 restores. As shown in FIGS. 3B to 3D, when the first pressing portion 18A sequentially presses the tube 20, moves toward the delivery direction, and sucks fluid on the upstream side, fluid in the tube 20 on the downstream side is delivered toward the delivery destination 5 side, i.e. the delivery destination side pipe line 4.

Figure 3A:
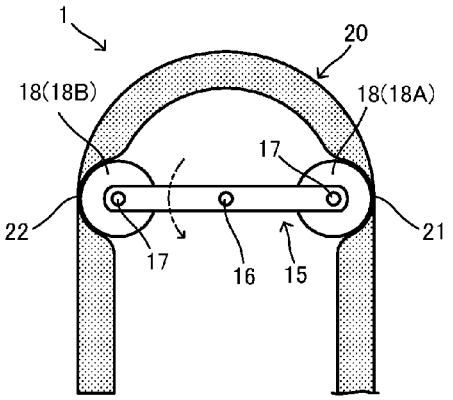
FIGS. 3A to 3E are partially broken plane views schematically showing the example of the fluid delivery method.
Figure 3B:
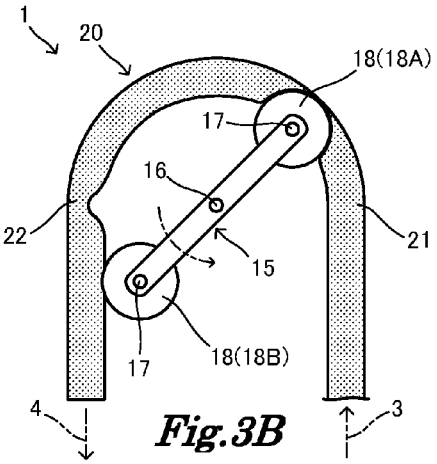
Figure 3C:
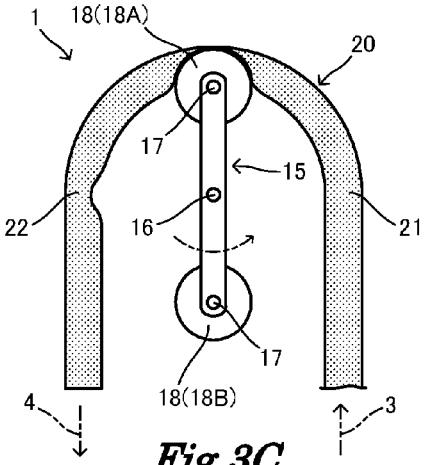
Figure 3D:
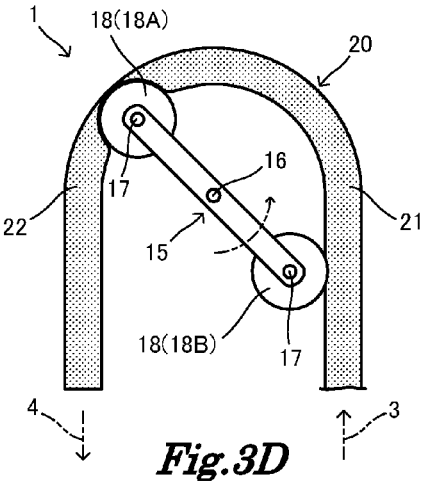
Figure 3E:
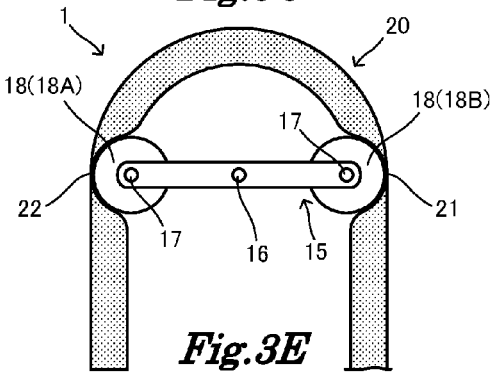

When rotated by 180 degrees, i.e. half rotation, from the initial position as shown in the FIG. 3A, the rotation body 15 turns back to the initial position as shown in FIG. 3E. In such a state that the rotation body 15 is at the initial position after being half rotated, the second pressing portion 18B is located on the most upstream side and the first pressing portion 18A is located at the most downstream side.

Namely, in the embodiment, the rotation body 15 is constituted to be at the initial position every time the rotation body 15 is rotated by 180 degrees; the rotation body 15 is constituted to deliver substantially the same amount, i.e. a fixed amount, of fluid every time the rotation body 15 is rotated by 180 degrees.

When the rotation body 15 is stopped at an appropriate rotation position, for instance, at the initial position, fluid delivery is stopped as mentioned above.

When such a stop state continues for a long time and the rotation body 15 is rotated normally in order to deliver fluid, the pressed area 21 on the upstream side of the tube 20 which is pressed by the pressing portion 18 is difficult to restore. When the pressed area 21 on the upstream side is pressed and the pressing portion 18 which presses the pressed area 21 moves toward the delivery direction, it becomes difficult to smoothly perform sucking fluid, i.e. a self-suction function, from the delivery source side, thereby causing a failure in fluid delivery.

In an example of the fluid delivery method in the embodiment which is executed using the tube pump 1 in the embodiment, the following constitution is adopted to prevent the delivery failure as mentioned above.

In the fluid delivery method in the embodiment, as shown in FIG. 2, the rotation body 15 is rotated toward the delivery direction after the rotation body 15 is rotated opposite to the delivery direction to reach the predetermined angle. Therefore, the pressed area 21 on the upstream side which is pressed by the pressing portion 18 (18A) on the most upstream side in the delivery direction of the tube 20 restores by the increase in pressure within the tube 20 accompanied with the movement opposite to the delivery direction of the pressing portion 18 (18B) adjacent to the downstream side in the delivery direction.

The example of the fluid delivery method is explained below referring to FIGS. 2 to 4.

Figure 2A:
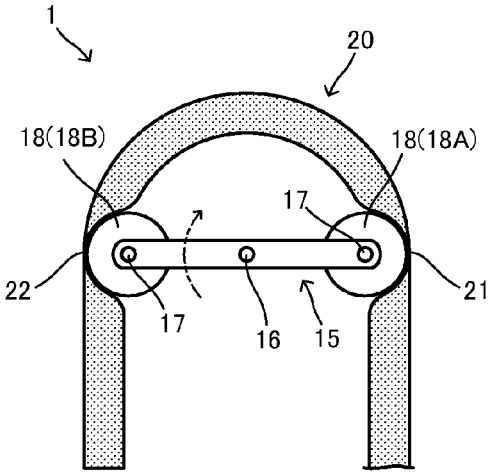
FIGS. 2A to 2D are partially broken plane views schematically showing an example of the fluid delivery method of an embodiment of the present invention executed with the tube pump.
Figure 2B:
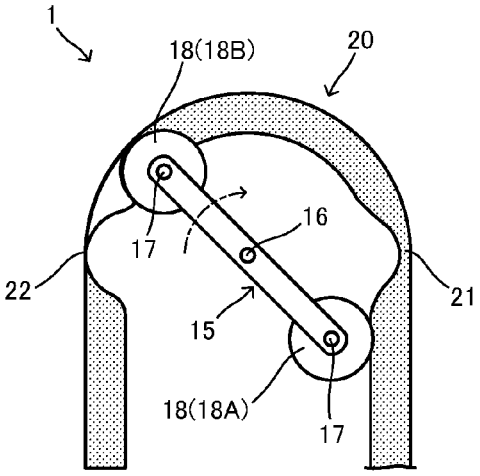
Figure 2C:
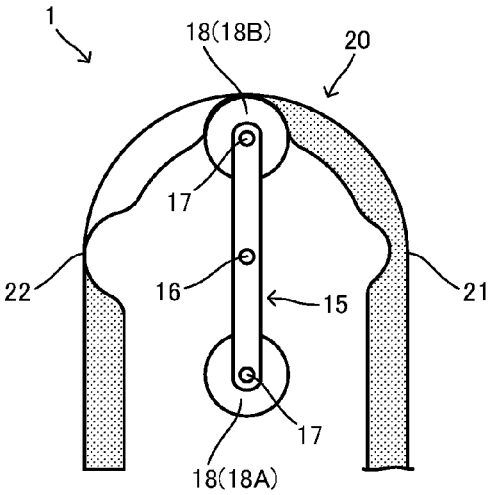
Figure 4:
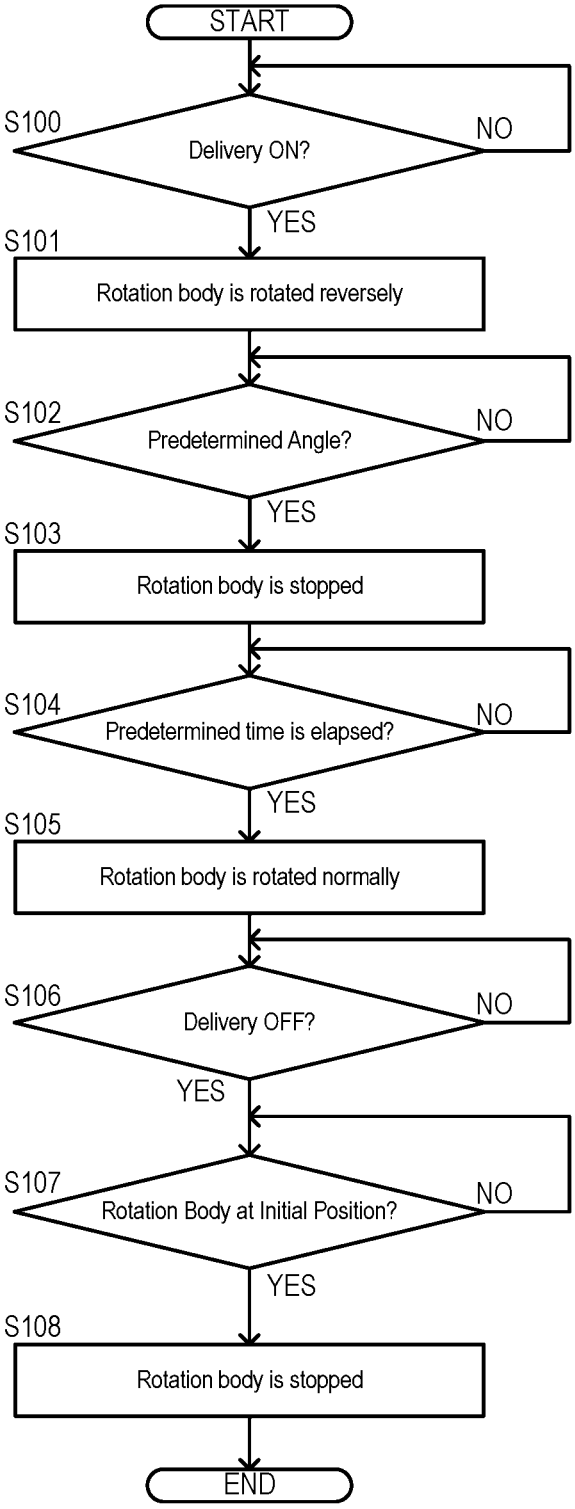
FIG. 4 is a schematic flowchart showing the example of the fluid delivery method.

When delivery is executed (delivery ON), i.e. a step 100, as shown in FIG. 4, the rotation body 15 is rotated reversely to reach the predetermined angle, i.e. steps 101 to 103, as shown in FIGS. 2A to 2C. In other words, by operating the drive unit 19, the rotation body 15 is rotated clockwise as shown in figures opposite to the delivery direction from the initial position, i.e. the stop position, shown in FIG. 2A until it reaches the predetermined angle.

The above-mentioned delivery ON can be detected, for instance, in such a manner that the control unit 26 receives a delivery ON signal. The delivery ON signal can be output based on operation input in the display operation unit 29 or the like, can be based on a delivery start signal (a request signal) from the delivery destination 5 side, or can be based on other actuating signals which are executed in various devices or systems into which the tube pump 1 is incorporated.

When the rotation body 15 is rotated reversely, as shown in FIGS. 2B and 2C, the first pressing portion 18A which is located on the most upstream side and presses the pressed area 21 on the upstream side of the tube 20 moves opposite to the delivery direction so as to estrange from the tube 20.

When the rotation body 15 is rotated reversely, the second pressing portion 18B which is adjacent to the downstream side and presses the pressed area 22 on the downstream side of the tube 20 sequentially presses the tube 20 and moves opposite to the delivery direction. Due to the movement opposite to the delivery direction of the second pressing portion 18B, the pressure increases within the tube 20 on the upstream side further than the second pressing portion 18B, thereby gradually restoring the pressed area 21 on the upstream side of the tube 20 which is pressed by the first pressing portion 18A which is located on the most upstream side at the initial position. Namely, the pressed area 21 on the upstream side is restored by compulsion due to increase in inner pressure of the tube 20 accompanied with the movement opposite to the delivery direction of the second pressing portion 18B. Although the pressed area 22 on the downstream side of the tube 20 which is pressed by the second pressing portion 18B is also considered difficult to restore, due to the movement opposite to the delivery direction of the second pressing portion 18B, the pressure in the tube 20 on the upstream side further than the pressed area 22 on the downstream side drops and becomes negative. The negative pressure function facilitates restoration in the pressed area 22 on the downstream side.

The predetermined angle at which the rotation body 15 reversely rotates from the initial position is not necessary to be one at which the pressed area 21 on the upstream side which is pressed by the pressing portion 18 completely restores and can be an angle for a restoration state at which sucking is possible when the rotation body 15 is rotated normally later. The rotation body 15 can be rotated reversely without reaching the initial position. Namely, in the embodiment, the rotation body 15 can be rotated by less than 180 degrees or can be rotated at an angle at which backflow of fluid into the delivery source side 2 does not occur. Such a predetermined angle can be appropriately set according to the inner diameter of the tube 20, a rotation radius of the rotation body 15, the number of the pressing portions 18, a roller diameter, a physical property of fluid, or the like. The figures show an example in which the rotation body 15 is rotated reversely from the initial position to the rotation position by 90 degrees. Whether the rotation body 15 is rotated opposite to the delivery direction until the predetermined angle or not can be discriminated in the control unit 26, for instance, can be discriminated in such a manner that the control unit 26 receives the signal from the detector such as the rotation angle sensor which detects the rotation position of the rotation body 15. The predetermined angle can be set in advance or can be input from the display operation unit 29 or the like.

Figure 2D:
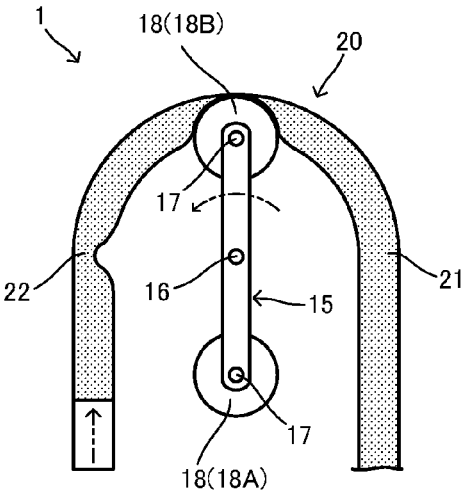

In the embodiment, as shown in FIG. 2D, the rotation position of the rotation body 15 which is rotated reversely can be retained during the predetermined time. Namely, as shown in FIG. 4, when the rotation body 15 which is rotated reversely is at the predetermined angle, i.e. a step 102, the rotation body 15 is stopped after the elapse of the predetermined time, i.e. steps 103 and 104.

As mentioned above, retaining the rotation position of the rotation body 15 which is rotated reversely during the predetermined time, as shown in FIG. 2D, facilitates restoration of the pressed area 22 on the downstream side by the above-mentioned negative pressure function. The predetermined time for which the rotation body 15 rotated reversely retains the rotation position is not necessary to be time needed for the pressed area 22 on the downstream side to restore completely and can be appropriately set according to the material or the diameter of the tube 20, the rotation radius of the rotation body 15, the roller diameter of the pressing portion 18, or the like. When the predetermined time is too long, fluid delivery start tends to be late; the predetermined time can be about a few seconds. The predetermined time is not limited to an aspect in which time from the point at which the rotation body 15 is rotated reversely and stops until it reaches the predetermined angle is detected by the control unit 26. By counting time passage from delivery ON, the aspect can be such that the above-mentioned passage of the predetermined time is detected by the control unit 26. The predetermined time can be set in advance or can be input by the display operation unit 29 or the like.

When the above-mentioned predetermined time is elapsed, the rotation body 15 is rotated normally, i.e. steps 104, and 105. Namely, in a substantially similar manner as mentioned above, as shown in FIGS. 2D and 3, the rotation body 15 is rotated counterclockwise as shown in figures toward the delivery direction by operating the drive unit 19. Thereby, fluid is delivered from the tube 20 toward the delivery destination 5 side, i.e. the delivery destination side pipe line 4.

When delivery is stopped, i.e. delivery OFF, and the rotation body 15 is at the initial position, the rotation body 15 is stopped, i.e. steps 106, and 107. Namely, the rotation body 15 is stopped by stopping the drive unit 19.

The above-mentioned delivery OFF can be detected, for instance, in such a manner that the control unit 26 receives a delivery OFF signal. The delivery OFF signal can be output based on operation input in the display operation unit 29 or the like, can be based on a delivery stop signal from the delivery destination 5 side, or can be based on other actuating signals which are executed in various devices or systems into which the tube pump 1 is incorporated. The initial position of the rotation body 15 can be detected by the control unit 26 or, for instance, in such a manner that the control unit 26 receives the signal from the detector such as the rotation angle sensor which detects the rotation position of the rotation body 15 as mentioned above.

In place of such an aspect, the aspect can be such that the rotation body 15 is controlled to be stopped after being rotated half or plural times or after being rotated until the predetermined amount of fluid is delivered.

The aspect is not limited to one in which the rotation body 15 is stopped at the initial position; or it can be such that the rotation body 15 is stopped at other positions.

Constituted as above, the tube pump 1 in the embodiment and the fluid delivery method using the tube pump 1 simplify the constitution and stably performing fluid delivery control.

Namely, the above-mentioned stop state continues for a long time, thereby preventing fluid delivery failure which is caused by incomplete restoration of the pressed area 21 on the upstream side. In other words, as mentioned above, the rotation body 15 is rotated reversely from the initial position, i.e. the stop position, to reach the predetermined angle, thereby restoring the pressed area 21 on the upstream side of the tube 20 which is pressed by the pressing portion 18 (the first pressing portion 18A) which is initially located at the most upstream side. The rotation body 15 is rotated normally in such a restoration state, thereby smoothly performing the fluid self-suction function from the delivery source side 2 accompanied with the movement toward the delivery side of the pressing portion 18 (the first pressing portion 18A) which is located at the most upstream side. Thereby, fluid is stably delivered and delivery failure is prevented. The constitution is simplified as compared with one in which an adhesion-state prevention member is inserted into the tube or in which a guide plate is provided with a guide hole which guides the pressure roller. As compared with the above-mentioned one, the pressing portions 18, 18 press the tube 20 when the rotation body 15 is stopped, thereby improving seal performance, preventing liquid dripping or the like on stopping, and stably stopping fluid delivery.

In the embodiment, the rotation position of the rotation body 15 rotated opposite to the delivery direction is retained during the predetermined time. Therefore, the pressed area 21 on the upstream side of the tube 20 which is pressed by the pressing portion 18 (the first pressing portion 18A) which is initially located on the most upstream side, i.e. the stop position, is more securely restored. As mentioned above, restoration of the pressed area 22 on the downstream side by the negative pressure function is facilitated. Thereby, when the rotation body 15 is rotated normally, fluid is more smoothly delivered. In place of such an aspect, the aspect can be such that the rotation body 15 is normally rotated immediately after the rotation body 15 is rotated reversely from the initial position, i.e. the stop position, to reach the predetermined angle.

Although the above-mentioned embodiment shows that, when delivery is executed (delivery ON), fluid is delivered in such a manner that the rotation body 15 is rotated normally after being rotated reversely, the aspect is not limited to the above-mentioned embodiment. For instance, the aspect can be such that the rotation body 15 is rotated reversely and normally in order that the pressed areas 21, 22 of the tube 20 easily restore every time the predetermined time, e.g. 24 hours, is over or when the stop state continues beyond the predetermined time. In the aspect, the rotation body 15 can be rotated reversely and normally without delivering fluid or can be rotated reversely and normally plural times in a repetitive manner.

The tube pump 1 is not limited to the above-mentioned embodiment. For instance, the rotation body 15 can be provided with three or more pieces of the pressing portions 18. In such a case, the rotation body 15 could be in the initial position at every angle which is obtained by dividing 360 degrees by the number of the pressing portions 18. A plurality of tubes can be provided in such a manner that the outer circumferential side of the rotation body is divided in the rotational direction and equally into a plurality of areas. A plurality of rotation bodies can be provided in the axial direction and in a parallel manner and a single or a plurality of tubes can be provided on each of the outer circumferential side. In addition to the above, the tube pump 1 can be in various constitutions.

Although the above-mentioned embodiment shows an example in which the fluid delivery method in the embodiment is executed using the tube pump 1 in the embodiment, the fluid delivery method in the embodiment is able to be executed using other types of tube pumps.

DESCRIPTION OF THE REFERENCE NUMERAL

1 tube pump
15 rotation body
18 pressing portion
19 drive unit
20 tube
21 pressed area on upstream side (area pressed by pressing portion on most upstream side in delivery direction)
26 control unit

The invention claimed is:

1. A tube pump comprising:

a plurality of pressing portions, the pressing portions spaced from each other, by equal intervals, in a rotational direction, the rotational direction comprising a delivery direction and a direction opposite to the delivery direction, the plurality of pressing portions provided on a rotation body turned by a drive unit; and a tube that delivers fluid, the tube provided on an outer circumferential side of the rotation body, wherein the tube pump comprises a controller that, upon detection of a fluid delivery ON signal and prior to delivery of fluid, turns the rotation body in the direction opposite to the delivery direction so as to restore, from a pressed state to an unpressed state, an area of the tube, pressed by the pressing portion on most a upstream side in the delivery direction, by an increase in pressure within the tube accompanied by a movement, in the direction opposite to the delivery direction, of the pressing portion adjacent to a downstream side and turns the rotation body in the delivery direction, the turning in the opposite direction being by an angle less than an angle defined by the intervals between adjacent pressing portions.

2. The tube pump as set forth in claim 1, wherein the controller maintains a rotational position of the rotation body, to which the rotation body was moved by the turning of the rotation body in the direction opposite to the delivery direction, for a predetermined time.

3. A fluid delivery method using a tube pump, the tube pump comprising: a plurality of pressing portions, the pressing portions spaced from each other, by equal intervals, in a rotational direction, the rotational direction comprising a delivery direction and a direction opposite to the delivery direction, the plurality of pressing portions provided to a rotation body turned by a drive unit; and a tube that delivers fluid, the tube provided on an outer circumferential side of the rotation body, the method comprising:

turning, at a time when fluid delivery is commanded and prior to delivery of fluid, the rotation body in a direction opposite to the delivery direction, so as to restore from a pressed state to an unpressed state, an area of the tube, pressed by the pressing portion on most a upstream side in the delivery direction, by an increase in pressure within the tube accompanied by a movement, in the direction opposite to the delivery direction, of the pressing portion adjacent to a downstream side in the delivery direction, and then turning the rotation body in the delivery direction, the turning in the opposite direction being less than an angle defined by the intervals between adjacent pressing portions.

4. The fluid delivery method as set forth in claim 3, wherein a rotational position of the rotation body, to which the rotation body was turned by the turning in the direction opposite to the delivery direction is maintained for a predetermined time.

5. The tube pump according to claim 1, wherein, when the rotation body is rotated in the direction opposite to the delivery direction, a pressing portion that is located on the most upstream side, in the delivery direction, is estranged from the tube.

6. The fluid delivery method according to claim 3, further comprising rotating the rotation body in the direction opposite to the delivery direction such that a pressing portion that is located on the most upstream side, in the delivery direction, is estranged from the tube.

7. The tube pump according to claim 1, the controller being configured to stop the rotation body at a stop position where an area of the tube on the upstream side is pressed and occluded by the pressing portion on the most upstream side in the delivery direction and fluid delivery is stopped.

8. The fluid delivery method according to claim 3, stopping the rotation body at a stop position where an area of the tube on the upstream side is pressed and occluded by the pressing portion on the most upstream side in the delivery direction and fluid delivery is stopped.

* * * * *